US009246204B1

(12) United States Patent
Kabakian

(10) Patent No.: US 9,246,204 B1
(45) Date of Patent: Jan. 26, 2016

(54) SURFACE WAVE GUIDING APPARATUS AND METHOD FOR GUIDING THE SURFACE WAVE ALONG AN ARBITRARY PATH

(71) Applicant: HRL LABORATORIES, LLC, Malibu, CA (US)

(72) Inventor: Adour V. Kabakian, Monterey Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 203 days.

(21) Appl. No.: 13/744,295

(22) Filed: Jan. 17, 2013

Related U.S. Application Data

(60) Provisional application No. 61/588,603, filed on Jan. 19, 2012.

(51) Int. Cl.
*H01P 3/10* (2006.01)
*H01P 3/00* (2006.01)
*H01P 1/02* (2006.01)

(52) U.S. Cl.
CPC .. *H01P 3/10* (2013.01); *H01P 1/02* (2013.01); *H01P 3/00* (2013.01)

(58) Field of Classification Search
CPC ..... H01P 3/10; H01P 3/18; H01P 3/20; H01P 1/02
USPC ..... 333/239, 240, 242, 248, 249
See application file for complete search history.

(56) References Cited

U.S. PATENT DOCUMENTS

| | | | | |
|---|---|---|---|---|
| 7,268,650 | B2 * | 9/2007 | Higgins | 333/248 |
| 2005/0040918 | A1 * | 2/2005 | Kildal | 333/239 |
| 2011/0181373 | A1 * | 7/2011 | Kildal | 333/239 |

OTHER PUBLICATIONS

From U.S. Appl. No. 14/310,895 (unpublished; non-publication request filed), Application and Office Actions.
Fong, B. et al., "Scalar and Tensor Holographic Artificial Impedance Surfaces," IEEE TAP., vol. 58 , 2010, pp. 3212-3221.
Gregoire, D.J., et al., "Surface-Wave Waveguides," Antennas and Wireless Propagation Letters, IEEE , vol. 10, 2011, pp. 1512-1515.
Gregoire, D.J., et al., Artificial impedance surface antenna design and simulation, Proc. Antennas Appl. Symposium 2010, pp. 288-303.
Gregoire, D.J., et al., Artificial impedance surface antennas, Proc. Antennas Appl. Symposium 2011, pp. 460-475.
(Continued)

*Primary Examiner* — Benny Lee
(74) *Attorney, Agent, or Firm* — Ladas & Parry

(57) ABSTRACT

An artificial impedance surface for rotating a surface wave on the artificial surface about a point along a circumferential path relative to said point in a phase preserving manner along said circumferential path. A method of guiding a transverse electric or transverse magnetic surface wave bound to an artificial impedance surface along a non-linear path comprising: smoothly rotating a principal axis of a surface tensor impedance matrix of the artificial impedance surface as a function of space, so the a propagation wavevector of the transverse electric or transverse magnetic surface wave rotates along with it, remaining aligned with the direction of the principal axis; and tailoring a surface wavenumber in a propagation direction of the non-linear path in such a way as to maintain a constant-phase for a wavefront of the transverse electric or transverse magnetic surface wave.

9 Claims, 15 Drawing Sheets

(56) References Cited

OTHER PUBLICATIONS http://www.microwaves101.com/encyclopedia/hybridcouplers.cfm, retrieved Jun. 10, 2014 (6 pages).
Luukkonen, O. et al., "Simple and accurate analytical model of planar grids and high-impedance surfaces comprising metal strips or patches", IEEE Trans. Antennas Prop., vol. 56, No. 6, pp. 1624-1632, 2008.
Patel, A.M.; Grbic, A., "A Printed Leaky-Wave Antenna Based on a Sinusoidally-Modulated Reactance Surface," Antennas and Propagation, IEEE Transactions on, vol. 59, No. 6, pp. 2087-2096, Jun. 2011.
Sievenpiper, D. et al., "Holographic AISs for conformal antennas", 29th Antennas Applications Symposium, 2005 (10 pages).
Sievenpiper, D. et al., 2005 IEEE Antennas and Prop. Symp. Digest, vol. 1B, pp. 256-259, 2005.

* cited by examiner

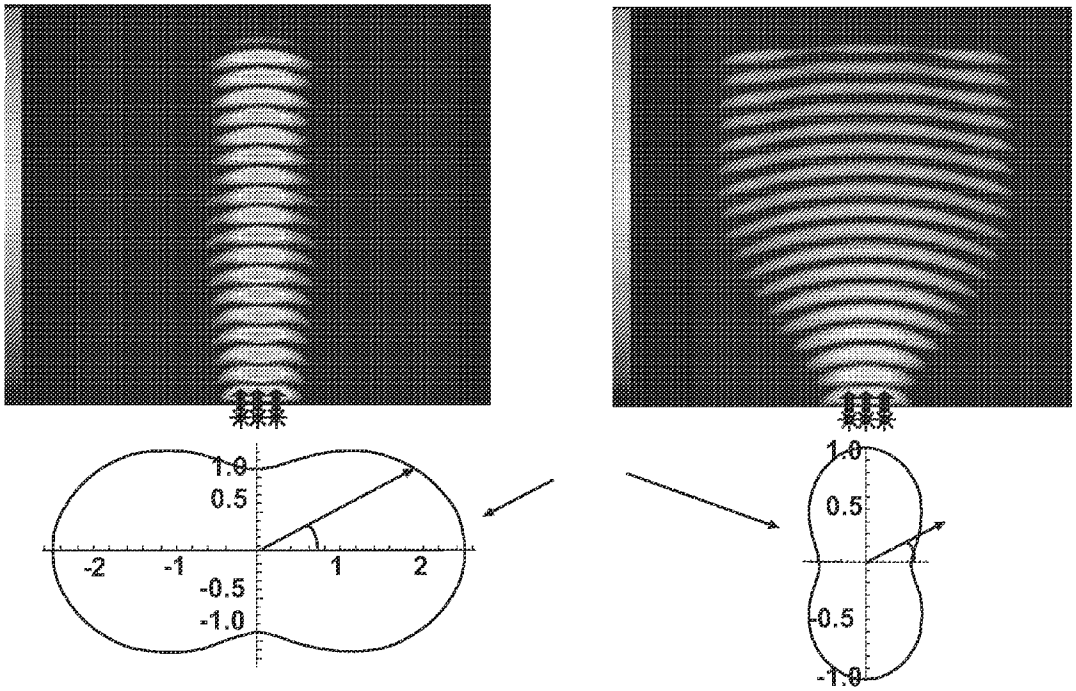
Fig. 2a
Fig. 2b
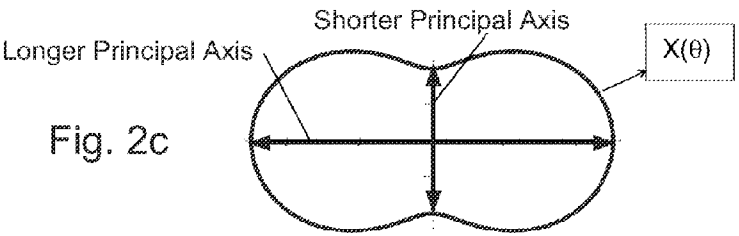
Fig. 2c

14

14

$$X_R = \left(\frac{R_c}{R}\right)^2 \left(1 + X_c^2\right) - 1$$

$$X_R = \left(\frac{R_c}{R}\right)^2 \left(1 + X_c^2\right) - 1$$

SURFACE WAVE GUIDING APPARATUS AND METHOD FOR GUIDING THE SURFACE WAVE ALONG AN ARBITRARY PATH

CROSS REFERENCE TO RELATED APPLICATIONS

This application claims the benefit of U.S. provisional patent application Ser. No. 61/588,603 filed Jan. 19, 2012, and entitled "Phase-Preserving Method for Steering and Guiding Surface Bound Waves on Artificial Tensor Impedance Surfaces", the disclosure of which is hereby incorporated herein by reference.

STATEMENT REGARDING FEDERALLY SPONSORED RESEARCH OR DEVELOPMENT

The present invention was made with support from the United States Government under contract number FA9550-09-C-0198 awarded by the Air Force Office of Scientific Research (AFOSR). The United States Government has certain rights in the invention.

TECHNICAL FIELD

This invention relates to how artificial tensor (anisotropic) impedance surfaces can be used to control the propagation of surface bound electromagnetic waves.

BACKGROUND

There is a need to transmit transverse electric (TE) or a transverse magnetic (TM) surface bound waves over surfaces far more efficiently than is possible by uncontrolled surface propagation. By achieving surface waveguide-like propagation, power can remain bound to the surface and localized to a desired path on that surface. This can provide more secure communications since waves remain attached to the surface (if desired), whereas antenna-based wireless communication system are apt to broadcast possibly sensitive information to the surroundings. It is desirable that the transverse electric (TE) or a transverse magnetic (TM) surface bound waves be able to follow an arbitrary path (having a smoothly changing radius of curvature) while maintaining a phase preserving wavefront.

BRIEF DESCRIPTION OF THE INVENTION

In one aspect the present invention provides an artificial impedance surface for rotating a surface wave on the artificial surface about a point along a circumferential path relative to said point in a phase preserving manner along said circumferential path.

In another aspect the present invention provides a method of guiding a transverse electric or transverse magnetic surface wave bound to an artificial impedance surface along a non-linear path comprising: smoothly rotating a principal axis of a surface tensor impedance matrix of the artificial impedance surface as a function of space, so that a propagation wavevector of the transverse electric or transverse magnetic surface wave rotates along with it, remaining aligned with the direction of the principal axis; and tailoring a surface wavenumber in a propagation direction of the non-linear path in such a way as to maintain a constant-phase for a wavefront of the transverse electric or transverse magnetic surface wave.

BRIEF DESCRIPTION OF THE DRAWINGS

FIG. 2*a* depicts a TM surface wave propagating on a flat plate and remains confined to the shorter principal axis of the tensor impedance plot depicted below the propagating surface wave.

FIG. 2*b* depicts another TM surface wave propagating on a flat plate having a tensor impedance plot as depicted below the propagating surface wave—in this case due to a favoring of the short principal axis direction for propagation, the TM surface of this figure manifests itself by a spreading out of the wave pattern.

FIG. 2*c* labels the shorter and long principal axes of the tensor impedance matrices depicted in FIGS. 2*a* and 2*b*.

FIG. 15*a* depicts log 10 scale surface currents for an isotropic constant-impedance waveguide with phase distortion, while

DETAILED DESCRIPTION

Figure 1A:
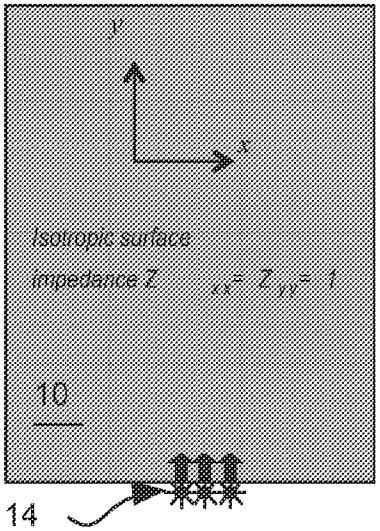
FIG. 1*a* depicts an impedance flat plate having an isotropic impedance vector and with dipole array for launching a surface TM wave generally in the y-direction.

Basic to understanding and appreciating this invention is an understanding that a transverse electric (TE) or a transverse magnetic (TM) surface bound wave tends to propagate along one of the principal axes of its surface tensor impedance matrix. By smoothly rotating the principal axis as a function of space, the propagation wavevector rotates along with it, remaining aligned with the direction of the principal axis. However, this should be done in conjunction with tailoring the surface wavenumber in the propagation direction in such a way as to maintain a constant-phase for the wavefront, which is necessary for achieving effective wave steering, i.e. turning (or rotating) the wavefront. Without this constraint, propagation direction control is limited to small angles and the surface wave beam is subject to spreading. It is the combination of rotating the principal axis supporting a pure TM/TE wave along with adjusting the local surface wavenumber to compensate for phase differences that makes it possible to achieve effective surface wave propagation control.

How to determine the tensor impedance matrix components to prescribe a propagation direction and how to rotate the wavefront to follow the propagation direction will now be described.

Pertinent Electromagnetic Theory

A tensor impedance matrix Z relates the components of the tangential electric and magnetic fields on the surface via $$E_t = Z\cdot(\hat{n}\times H_t),$$

where $\hat{n}$ is the surface normal, and $E_t$ and $H_t$ are electric and magnetic field components tangential to the impedance surface. Consider, for simplicity's sake, the surface is to be in the xy-plane (FIG. 1), then the above boundary condition equation becomes (using a matrix as opposed to a tensor notation):

$$\begin{bmatrix} E_x \\ E_y \end{bmatrix} = \begin{bmatrix} Z_{xx} & Z_{xy} \\ Z_{yx} & Z_{yy} \end{bmatrix}\begin{bmatrix} J_x \\ J_y \end{bmatrix}, \text{ with } \begin{bmatrix} J_x \\ J_y \end{bmatrix} = \begin{bmatrix} -H_y \\ H_x \end{bmatrix}, \quad \text{(Eqn. 1)}$$

where the Z components are assumed to be purely imaginary and $Z_{xy}=Z_{yx}$.

For a pure TM wave, the fields are assumed to be of the form $$E_{TM}=1/k[-\hat{z}k_t^2+ik_zk_t]e^{ik_t\cdot x_t}e^{-k_z z} \text{ and } H_{TM}=\hat{z}\times k_t e^{ik_t\cdot x_t}e^{-k_z z} \quad \text{(Eqn. 2)}$$

where k is the free space wavenumber, and $k_t$ and $k_z$ are the surface tangential and normal wavenumbers, respectively. For propagation in the θ-direction, $$k_t = k_t\begin{bmatrix} \cos\theta \\ \sin\theta \end{bmatrix}.$$

For a pure TE wave, the fields are assumed to be of the form $$E_{TE}=\hat{z}\times k_t e^{ik_t\cdot x_t}e^{-k_z z} \text{ and } H_{TE}=1/k[\hat{z}k_t^2+ik_zk_t]e^{ik_t\cdot x_t}e^{-k_z z} \quad \text{(Eqn. 2)}$$

Directional Confinement of Surface Wave Propagation

For the impedance matrix Z to support a pure TM wave, its components have to be such that the tensor impedance boundary condition (Eqn. 1) must be satisfied for the TM field expressions (Eqn. 2).

Defining the matrix X=iZ that has real positive components, this results in the condition:

$$\begin{bmatrix} \frac{k_z}{k}\cos\theta_k \\ \frac{k_z}{k}\sin\theta_k \end{bmatrix} = \begin{bmatrix} X_{xx} & X_{xy} \\ X_{xy} & X_{yy} \end{bmatrix}\begin{bmatrix} \cos\theta_k \\ \sin\theta_k \end{bmatrix},$$

which can be cast in the eigenvalue problem form for the effective impedance ($k_z/k$)

$$X\hat{k}_t = \left(\frac{k_z}{z}\right)\hat{k}_t \quad \text{(Eqn. 3)}$$

Analysis of the above system indicates that a pure TM mode can be supported only if matrix X is diagonalizable, and only along its principal axes. A similar eigenvalue problem is obtained for the TE case by defining a matrix Y=−iZ, which produces an eigenvalue problem for $1/(k_z/k)$, with $\hat{k}_t$ replaced by its transverse $$\begin{bmatrix} -\sin\theta \\ \cos\theta \end{bmatrix}.$$

It is important to understand that a pure TM wave tends to excite and favor the mode corresponding to the shorter principal axis as it propagates over a surface, and hence energy tends to propagate along the direction of the shorter principal axis (see FIG. 2*c* which labels the longer and shorter principal axes). X is the effective impedance for a wave propagating in the θ-direction (from the x-axis). X(θ) reaches a minimum when the propagation direction is along the shorter principal axis, which is the direction of propagation favored by pure TM waves, which tends to confine the energy along the principal axis, producing a beam-like pattern that may also be interpreted as a pattern having been produced by a boundary-free waveguide. The smaller the ratio of the propagation direction principal axis length to the longer perpendicular principal axis length, and the more focused the beam appears. Conversely, as this ratio is made greater than one, the beam tends to spread out. As for the TE case, since the eigenvalue problem is for the transverse of the surface propagation wavevector, propagation is favored along the longer principal axis of matrix Y, and beam focusing/spreading is, therefore, also reversed accordingly in comparison to the TM case. Note that FIGS. 2*a* and 2*b* depict TM propagation along the shorter and longer principal axes, respectively, with the impedance values as a function of propagation direction shown underneath the surface current patterns in these figures.

Figure 1B:
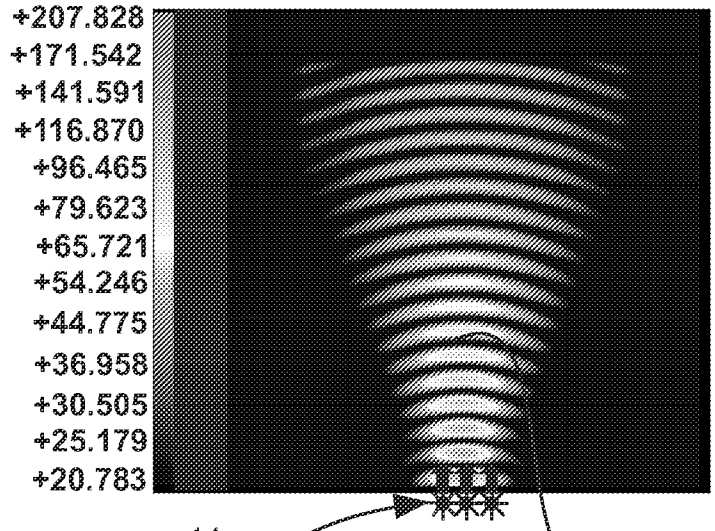
FIG. 1*b* depicts a surface current on a flat plate depicting propagation pattern of launched surface wave.
Figure 1C:
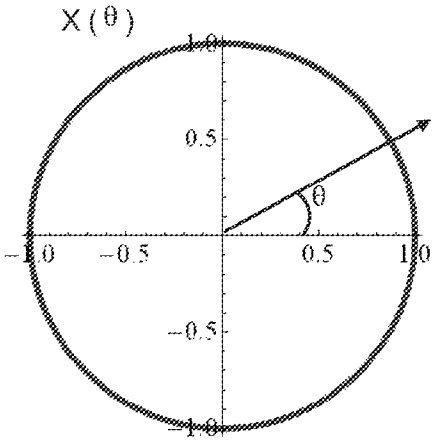
FIG. 1*c* depicts an isotropic (scalar) surface impedance which is the same for all propagation directions for the flat plate of FIGS. 1*a* and 1*b*.

The effect just described can be simulated with a series of FastScat™ (trademark of HRL Laboratories for computer code which calculates and models electromagnetic scattering) simulations, using the setup depicted in FIG. 1*a*, which shows an impedance plate 10 (with the xy plane identified thereon and having an isotropic surface impedance Z so that $Z_{xx}=Z_{yy}=1$) supporting a surface bound TM wave 12 (see FIG. 1*b*) launched by a dipole array 14. One can use the diagonal impedance matrix $$X^d = \begin{bmatrix} X_x^d & 0 \\ 0 & X_y^d \end{bmatrix}$$

for these simulations, without loss of generality, as its principal axes in the x- and y-directions can be rotated arbitrarily. We use as reference the y-direction surface propagation pattern shown in FIG. 1*b* for the case of isotropic impedance $X_x^d=X_y^d=X(\theta)=1$. As such, $X(\theta)$ is described as a circle in a polar plot of the effective impedance $X(\theta)$ as a function of propagation direction $\theta$, as shown in FIG. 1*c*. If we set $X_x^d=2.5$ and keep the shorter propagation direction principal axis length $X_y^d=1$, we obtain the focused beam and the anisotropic effective impedance as a function of propagation direction plot shown in FIG. 2*a* (the reader can also see this plot in FIG. 2*c* where it is labeled as $X(\theta)$). In contrast, if we set instead $X_y^d=1/2.5=0.4$ and keep $X_x^d=1$, we get the beam spreading effect shown in FIG. 2*b*, relative to the reference pattern of FIG. 1*b*. FIG. 2*c* labels the shorter and long principal axes of the tensor impedance matrices depicted in FIGS. 2*a* and 2*b*. In either case (FIG. 2*a* or FIG. 2*b*), note how the value of $X(\theta)$ as a function of propagation direction $\theta$ changes with a changing propagation direction $\theta$.

The impedance plate is preferably formed as a sheet dielectric upon which metallic patches or elements are arranged (as an array) with varying sizes and/or shapes and/or orientations in order to give the impedance plate a desired impedance distribution. Examples for impedance plates which direct surface waves in a desired direction are discussed in due course below.

Controlling the Propagation Direction

Figure 3:
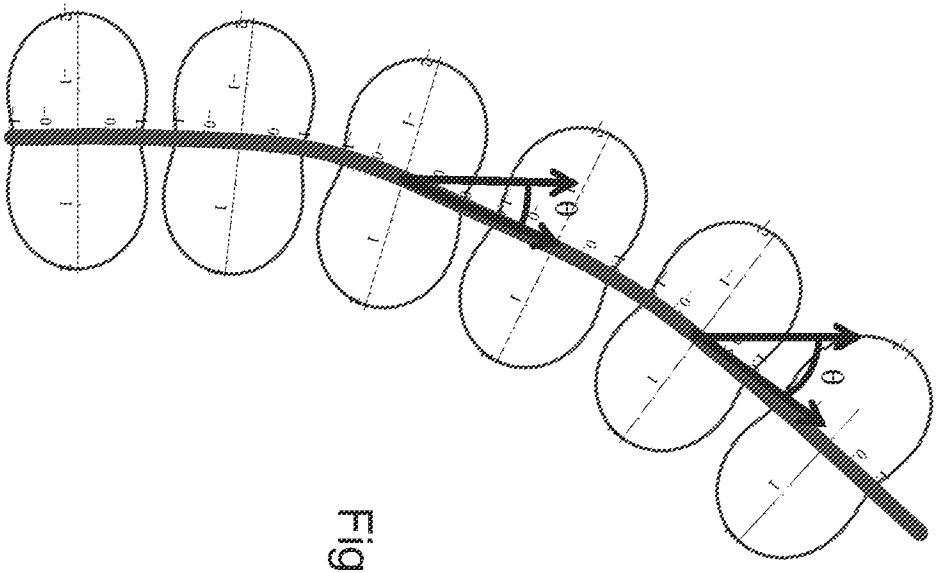
FIG. 3 depicts how rotating the principal axis of the tensor impedance matrix would be expected to excite the propagating mode in the direction of rotation.

The most powerful application of this phenomenon, i.e. the tendency of a TM surface wave to propagate along the shorter principle axis of the impedance matrix, is that it enables directing a surface wave towards a direction $\theta$, by smoothly rotating the short principal axis of the tensor impedance surface, keeping it aligned with the intended propagation direction $\theta$, as illustrated in FIG. 3. Note by the integer numbers depicted on FIG. 3 how the value of $X(\theta)$ as a function of propagation direction $\theta$ changes with a changing propagation direction $\theta$. It should also be noted how the direction of $\theta$ changes with a changing surface location, thereby causing the surface bound wave direction to rotate along a smooth path identified by the thickest line of FIG. 3. The axis rotation transformation can be derived straight from the eigenvalue problem in Eqn. 3 as $$X = SX^dS^T, \text{ where } S = S(\theta) = \begin{bmatrix} \cos\theta & -\sin\theta \\ \sin\theta & \cos\theta \end{bmatrix}, \quad \text{(Eqn. 4)}$$

where $\theta=\theta(x,y)$ is a function of surface location, and where the diagonal matrix $X^d$ is:

$$X^d = \begin{bmatrix} X_x^d & 0 \\ 0 & X_y^d \end{bmatrix}.$$

Figure 4A:
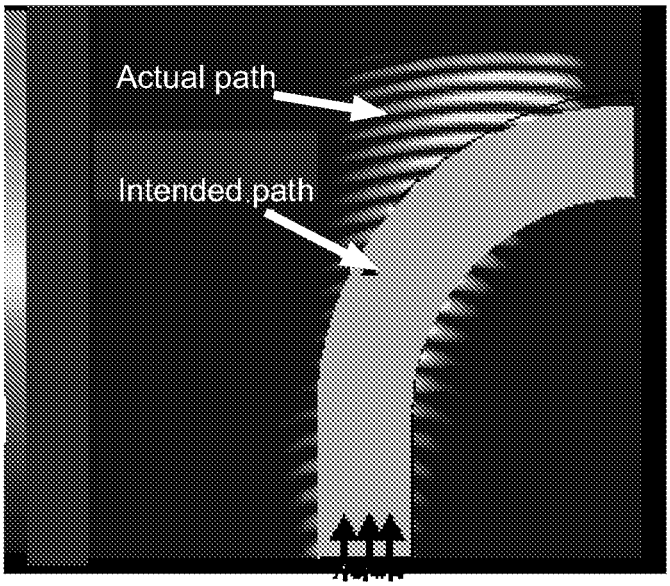
FIGS. 4*a* and 4*b* depict how rotating the principal axis alone is insufficient for achieving full propagation direction control.
Figure 4B:
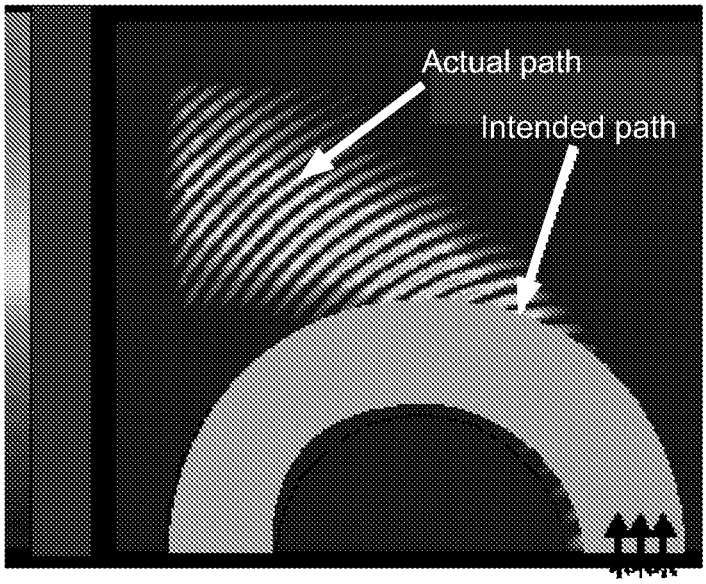

By smoothly rotating the axes as we sweep across the surface, the TM mode corresponding to the new direction gets excited, directing energy from dipole array 14 in this new direction. However, simply rotating the principal axis produces only partial steering, as shown in FIGS. 4*a* and 4*b*, where the actual propagation pattern follows only loosely the intended propagation path traced by axis rotation for a short distance and then departs from the intended path. A close examination of FIGS. 4*a* and 4*b* indicates that while significant energy does indeed start to propagate along the intended path, the wavefront does not fully rotate towards the intended propagation direction. So while the wavefront is turned slightly, it certainly is not fully turned, so that it does not follow the intended path completely.

Turning the Wavefront

Figure 5:
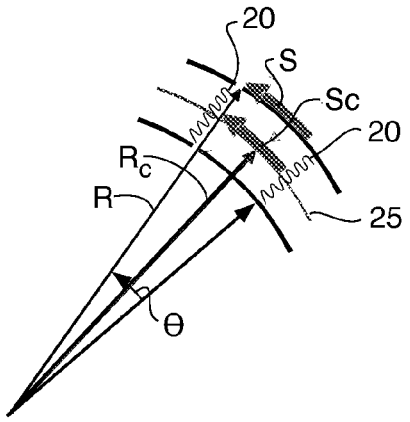
FIG. 5 demonstrates that the wavefront (phasefront) is maintained by keeping the path lengths at different radii proportional to the tangential surface wavelength—in other words, the electrical paths lengths corresponding to physical arc lengths s and $s_c$ are kept equal.
Figure 6:
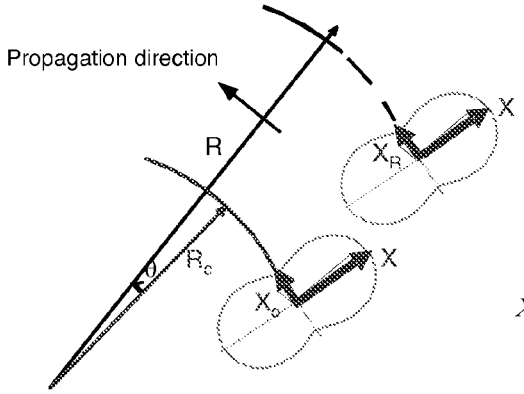
FIG. 6 is a pictorial summary of concepts for surface wave propagation control by artificial tensor impedance surfaces.
Figure 14:
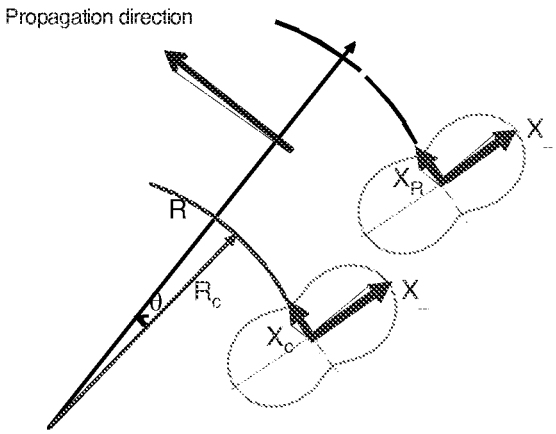
FIG. 14 depicts the impedance grading across waveguide and tensor impedance.

It is also important to understand that, in addition to rotating the principal axis of the tensor impedance along the desired path, as depicted by FIG. 3, the tangential surface wavelength needs to remain proportional to the propagation length along a curved path to maintain a constant phasefront as the surface rotates the wavefront of the surface wave, in order to result in effective steering. FIG. 5 shows a wavefront 20 propagating along an intended curved path 25 (with a changing propagation direction $\theta$ due to the curved path). The curved path shown in FIG. 5 might well be just a portion of some arbitrary path that the wavefront is intended to follow. The propagation paths Sc and S, corresponding to the radii of curvature $R_c$ and R, should contain the same number of surface tangential wavelengths, i.e., the electric path lengths S and Sc should be the same, in order to help keep the wavefront from diverging away from the intended path as it does in the embodiments of FIGS. 4*a* and 4*b*. The surface tangential wavelength $\lambda_t$ is related to the tangential wavenumber $k_t$ via $k_t=2\pi/\lambda_t$, which for a TM wave is given by $$k_t = k\sqrt{1+X^2},$$

where X is the effective impedance magnitude in the propagation direction as shown in FIGS. 6 and 14, which in this case corresponds to the short principal axis direction. The equal electric path length requirement is $$\frac{s}{\lambda_t(R)} = \frac{s_c}{\lambda_t(R_c)}.$$

From which we obtain the relationship for how the impedance in the propagation direction 25 must vary as a function of radius of curvature to maintain constant phase:

$$X_R = \sqrt{\left(\frac{R_c}{R}\right)^2 (1+X_c^2) - 1}, \quad \text{(Eqn. 5)}$$

where $X_R$ is the principal axis impedance magnitude at an arbitrary radius R, expressed as a function of the impedance magnitude $X_c$ at radius $R_c$ as shown in FIGS. 6 and 14.

Figure 7:
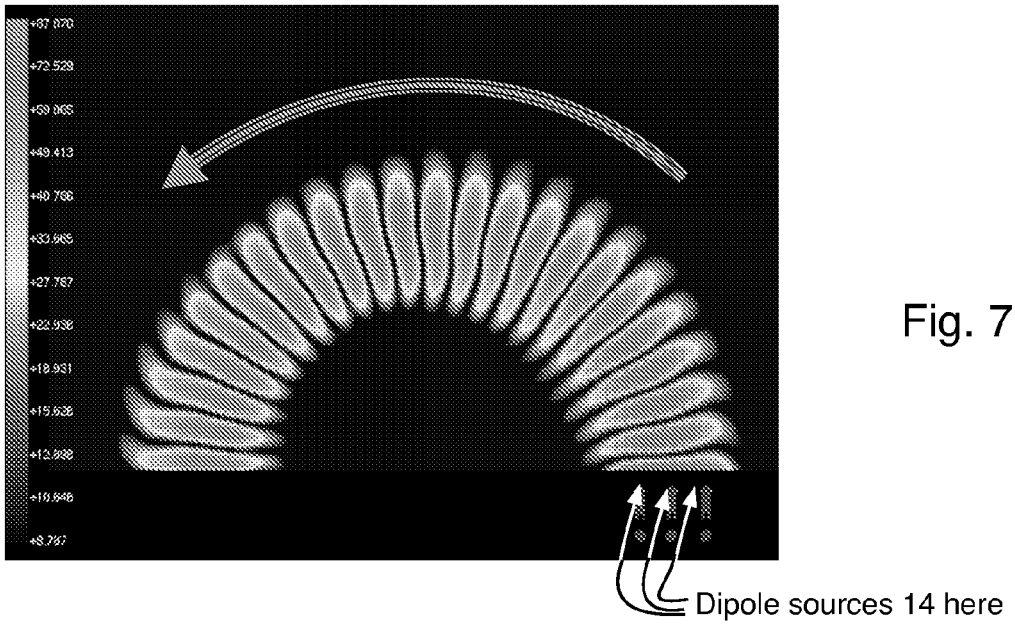
FIG. 7 depicts how full propagation control is achieved by combining principal axis rotation with effective impedance grading to maintain constant phase.

Applying both axis rotation via Eqn. (4) and phase correction by effective impedance grading via Eqn. (5), as depicted in FIG. 6 (where the changing propagation direction $\theta$ is noted again in FIG. 6 and in FIG. 14), we obtain full propagation control, as illustrated by the simulation in FIG. 7, which shows a TM surface wave tracing a semi-circle with a constant phasefront with negligible energy leakage in other directions. In this embodiment no specific impedance boundaries are defined. If the dipole source array 14 were moved either a little to the left or the right in FIG. 7, the wavefront will still trace a circular arc and reach the left hand side of FIG. 7 in the same elapsed time. However, this is limited in two ways. When the radius R of the curve becomes too small compared to the reference radius $R_c$ (see FIG. 6), the needed impedance becomes too high to be realizable with these patches. On the other extreme, if the radius becomes too large, the value under the square root of the formula becomes negative, and therefore no physical value can be obtained. We interpret this as meaning that we simply cannot continue increasing the speed of propagation as we move further out from the center of rotation.

For the TE case, we do a very similar analysis, but with the surface tangential wavenumber given by $$k_t = k\sqrt{1 + 1/Y^2},$$

which leads to $$Y_R = \frac{1}{\sqrt{\left(\frac{R_c}{R}\right)^2\left(1 + \frac{1}{Y_c^2}\right) - 1}},$$

where $Y_R$ is a principal axis admittance magnitude at an arbitrary radius R, expressed as a function of the admittance magnitude $Y_c$ at a radius $R_c$.

Figure 8:
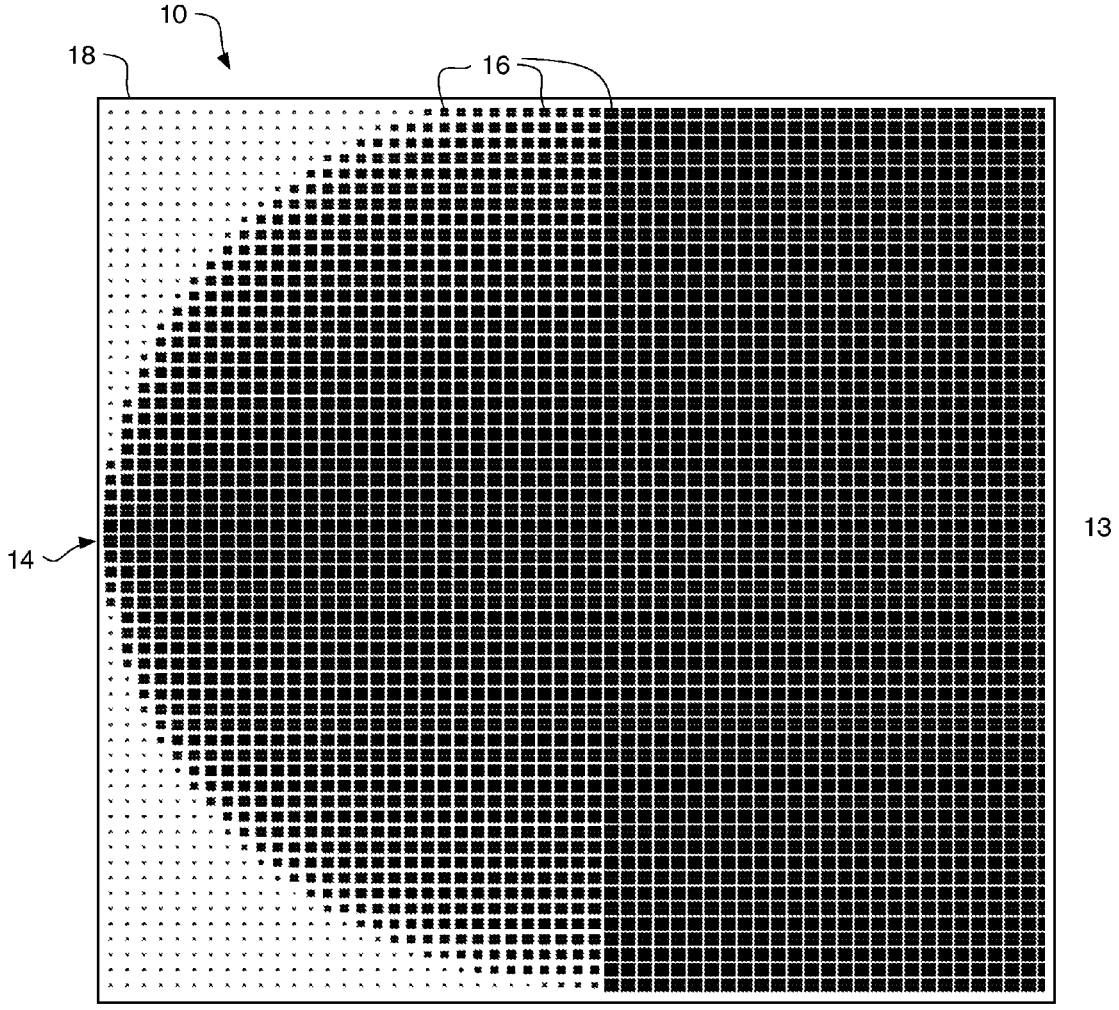
FIGS. 8 and 8*a* depict two embodiments of a phase preserving artificial impedance surface which acts as a lens that converts a point source into a plane wave.

Turn now to FIG. 8 which depicts one embodiment of a phase preserving artificial impedance surface 10 comprising a two dimensional array of electrically conductive patches or elements 16 (which patches or elements 16 are preferably implemented as metallic patches and are depicted in black) disposed on a dielectric surface 18. The techniques described above can be used to size and locate the patches 16 on surface 18. In this embodiment, the impedance surface 10 acts as a lens that converts a point source 14 into a plane wave (at end 13 of surface 18) (and vice versa through reciprocity). Such a lens is created with the techniques described above by defining the impedance function for an entire surface 18.

The patches 16 depicted in the embodiment of FIG. 8 have approximately twenty different size possibilities and it should be apparent that these patches approximate the desired impedance function, since the desired impedance function tends to smoothly vary on the surface while the patches used to emulate it on the surface are discrete. The patches 16 need not be square in shape as depicted in FIG. 8 and the number of possibilities of shapes and sizes of the patches 16 may be varied in order to control how closely the surface impedance function of surface 10 approximates or emulates the desired impedance function. An impedance boundary can be seen where the patches 16 quickly change size in accordance with the equations set forth above. In the embodiment of FIG. 8 the smallest size patch (of the twenty sizes available in this embodiment) occur consistently outside a defined region and the patches gradually change size within the defined region until they attain the largest of the twenty available sizes. The regions at the top and bottom left hand side of FIG. 8 where the smallest size patches are depicted can alternatively be made patch-free (conceptually then the smallest size patch then has a size of zero) effectively then defining a sharp impedance boundary thereat.

Figure 8A:
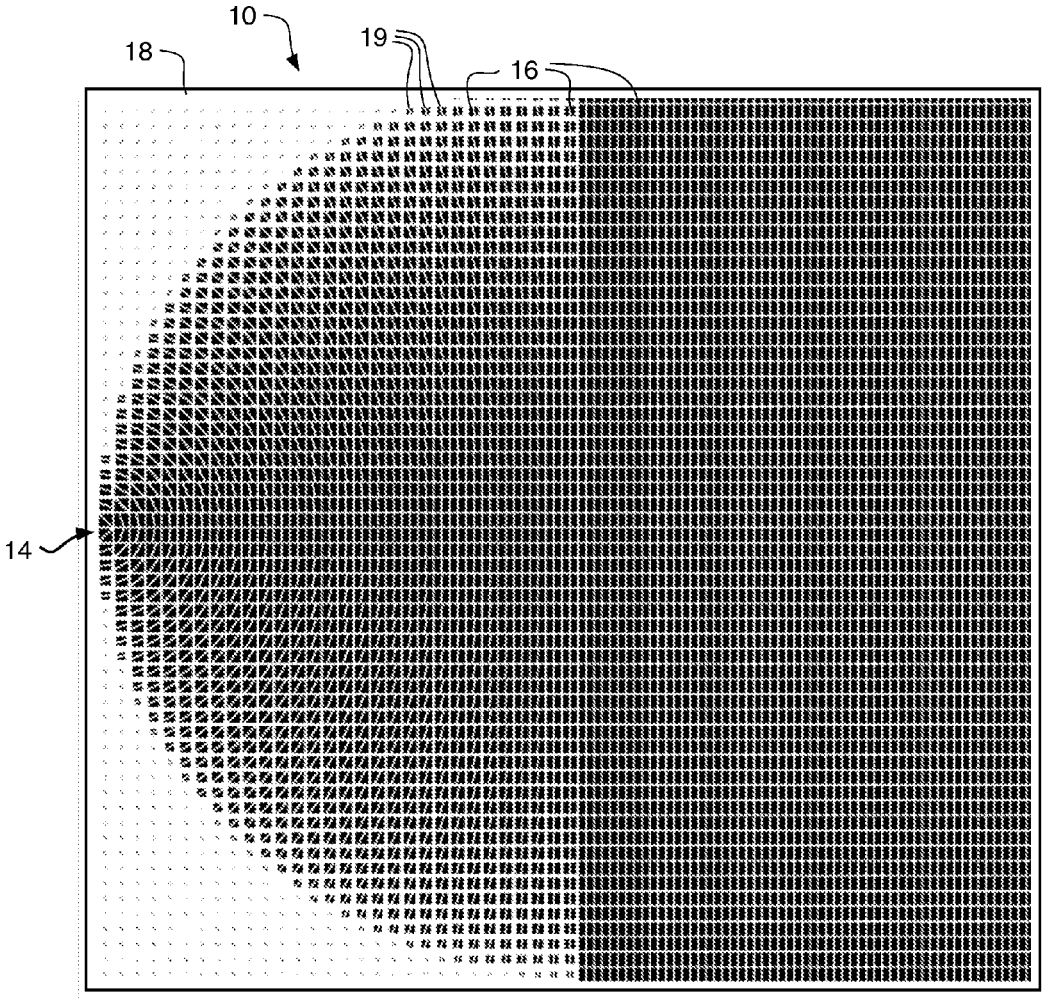

FIG. 8*a* shows another embodiment wherein the patches 16 on dielectric surface 18 are sliced compared to the embodiment of FIG. 8. Note how the angles of the slices 19 (see also FIG. 9*b*) in patches 16 tend to be tangential to circles centered on the point source 14. So both the size and orientation of the patches gradually change within the defined region until they attain the largest of the available sizes.

Figure 9A:
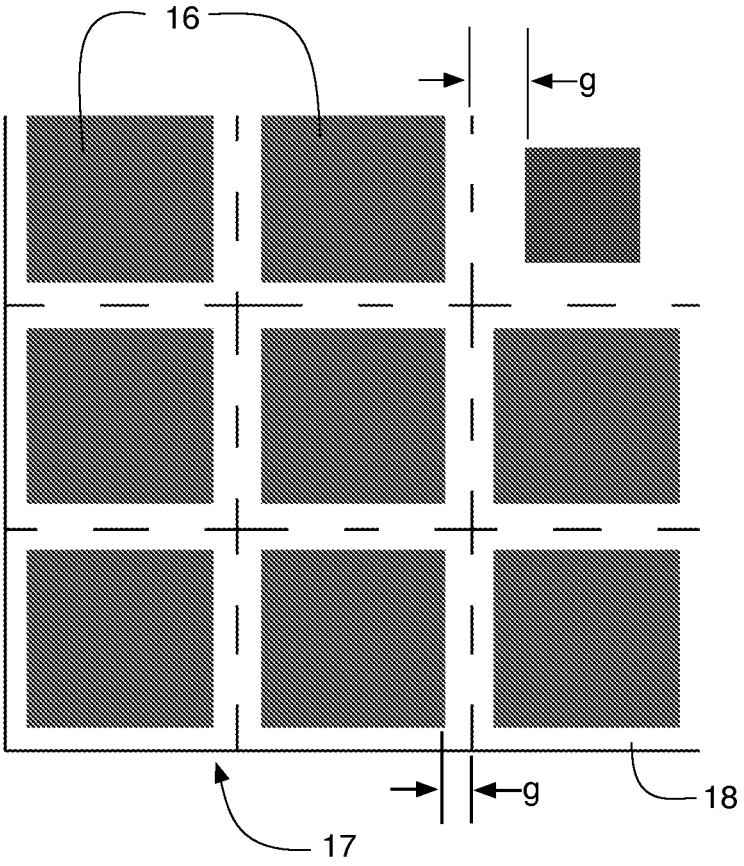
FIG. 9*a* shows a small portion of a array of metallic patches on a dielectric surface.

FIG. 9*a* shows a small portion of an array of metallic patches 16 on a dielectric surface 18. Typical arrays have many more patches 16 than shown in FIG. 9*a*. This figure is used to define a gap size "g" of the patches 16. The patches 16 formed on surface 18 are preferably arranged in a grid pattern of fixed size unit cells 17 in this embodiment, with the size of each patch 16 within each cell 17 varying as needed (or as allowed if the number of possible patch sizes is constrained to some value) to emulate the desired impedance function. Larger patches 16 have smaller gaps g than do relatively smaller patches 16. Compare the relatively smaller patch in the upper right hand corner compared to the other patches 16 depicted in FIG. 9*a*. The gap sizes g may be the same dimension along both directions (vertical and horizontal as depicted in FIG. 9*a*) for each given patch 16. The scalar impedance value Z is controlled by sizing the gap sizes of the patches 16. The smaller the gap, the higher the impedance.

The patches 16 provide a piecewise approximation to the desired impedance function. Since the patches 16 are preferably 6-12 times smaller than the wavelength of the propagating surface wave, such piecewise approximation is reasonably accurate. Gap size "g" is selected to best approximate the impedance value at a point on the surface that coincides with the center of the patch 16 or center of the cell 17. The patches 16 may be even smaller than one twelfth of a wavelength of the propagating surface wave in order to obtain an even better piecewise approximation of the desired impedance function, if desired, but at some point the difficulty in manufacturing a dielectric surface with such very small patches outweighs the potential benefits of a finer piecewise approximation of the desired impedance function.

Figure 9B:
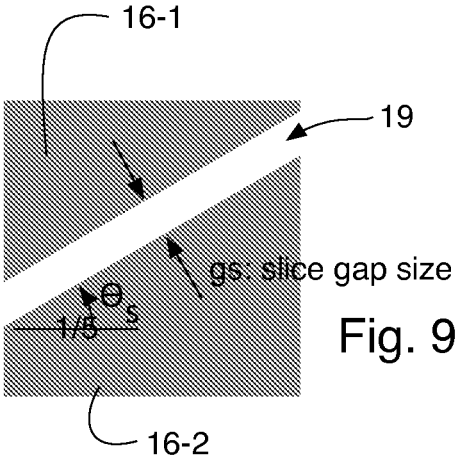
FIG. 9*b* depicts a square shaped patch with a slice removed therefrom.
Figure 9C:
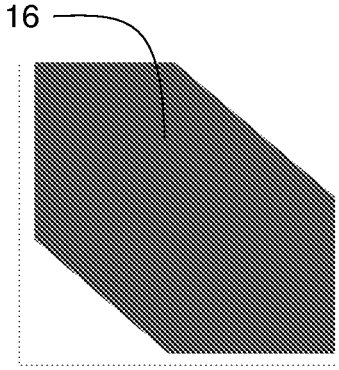
FIG. 9*c* depicts a bar shaped patch.

Adding a slice 19 (see FIG. 9*b*) through a scalar square patch 16 (so the patch 16 now has two (or more) portions, 16-1 and 16-2) produces an anisotropic impedance (tensor), meaning that the effective impedance seen by a surface wave is a function of its direction of propagation. The three independent components of the impedance matrix are controlled by the peripheral gap size "g", the slice angle "$\theta_s$", and the slice gap size "gs" as shown in FIG. 9*b*. FIG. 9*c* shows another embodiment of a patch 16 (having a "bar" shape) for generating an anisotropic impedance (tensor). Other geometric shapes can be adopted for patches 16 consistent with the teachings herein. An anisotropic impedance (tensor) is useful in helping to rotate the principal axis of the tensor impedance along the desired path.

Figure 10:
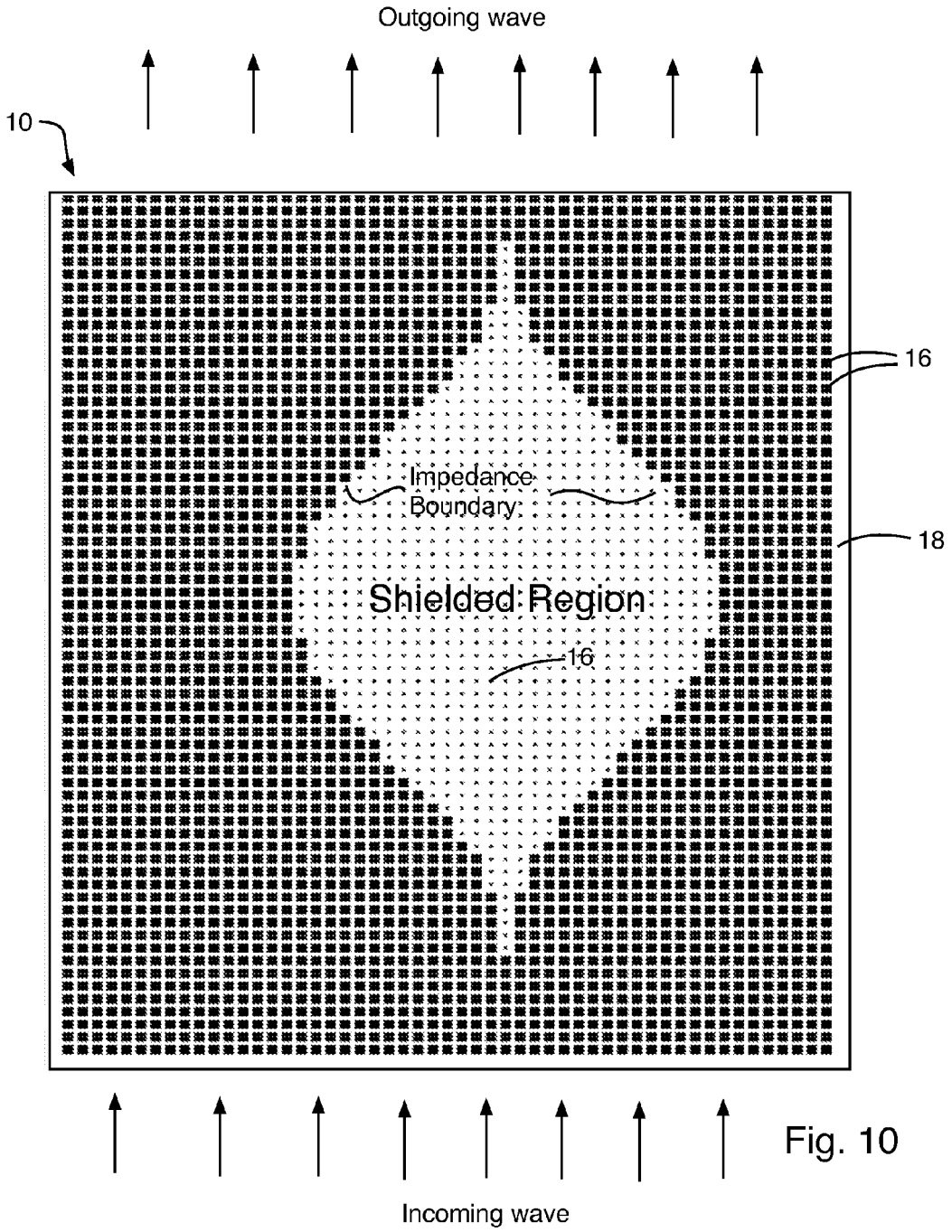
FIG. 10 depicts an artificial impedance surface that shields a central portion of the surface from a surface wave traveling on the surface.

FIG. 10 depicts an artificial impedance surface 10 formed by dielectric surface 18 that shields a central portion (the "Shielded Region") of the surface 10 from a surface wave traveling on the surface by creating a tensor impedance which moves the surface wave away from the depicted Shielded Region. The patches 16 within the Shielded Region may have a size of zero (so that Shielded Region may be made devoid of patches as opposed to have a very small patch size as depicted in FIG. 10). The Shielded Region is defined by an impedance boundary which occurs where the patches 16 change size (as shown by FIG. 10) or by an boundary which occurs where there is a region of patches of size zero surrounded by a region of patches of non-zero size. In either case an incoming surface wave is moved away from the shielded region before exiting the surface as an outgoing wave.

Figure 11A:
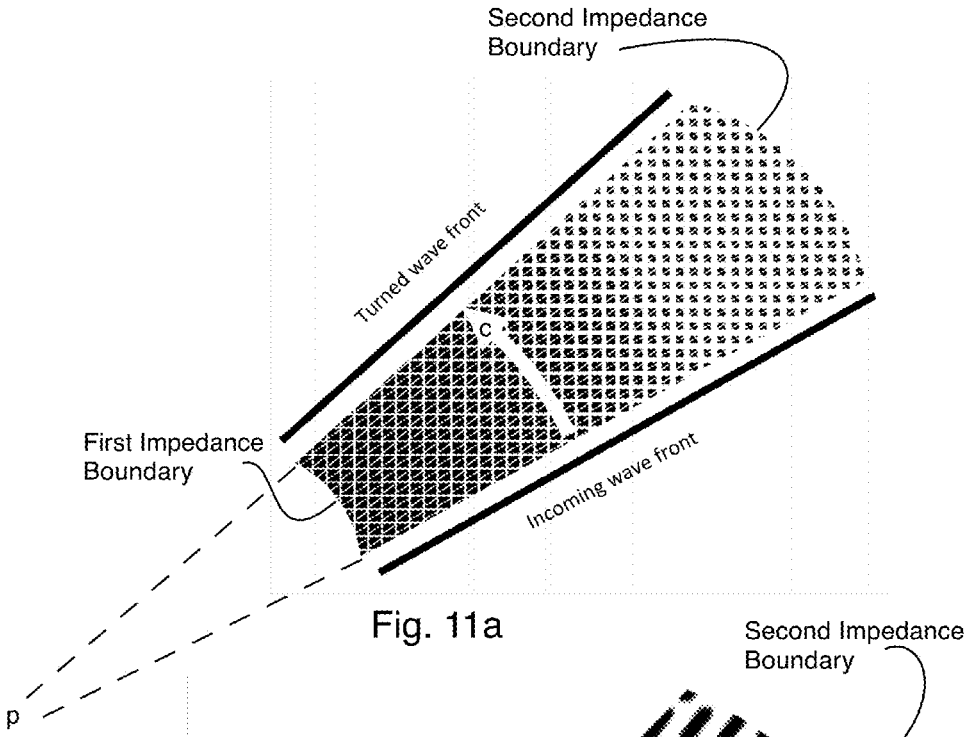
FIGS. 11*a* and 11*b* depict embodiments of an artificial impedance surface section that turns wave front in phase-preserving fashion.
Figure 11B:
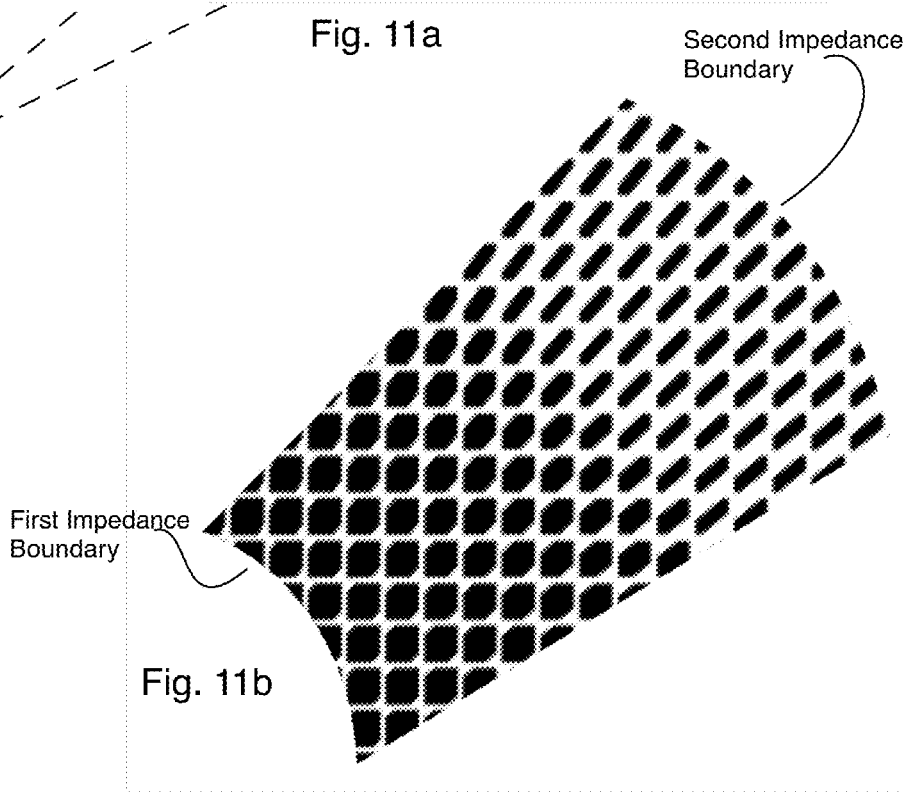

FIGS. 11*a* and 11*b* depict embodiments of an artificial impedance surface section that turns an incoming wave front along the arrow indicated in white on FIG. 11*a* to produce a turned wave front in a phase-preserving fashion. The embodiment of FIG. 11*a* is realized with "sliced" patches of the type shown in FIG. 9*b* while the embodiment of FIG. 11*b* is realized with "bar" patches of the type shown in FIG. 9*c*. In these two figures the first area between the first Impedance Boundary point p (about which the incoming surface wave wavefront is to be rotated as shown in FIG. 11*a*) may be devoid of patches as shown. Likewise in these two figures the second area outboard of the second Impedance Boundary may be devoid of patches as shown. On the other hand, those first and second areas may be provided with patches sized, shaped or oriented as defined by the equations set forth above. But the addition of sharper impedance boundaries (than dictated by the equations set forth above) helps to further confine the propagating wavefront to a desired region (or regions) on the dielectric surface and this can be especially beneficial when the propagating wavefront needs to make more than just one turn about a single rotation point p but that is intended to follow some arbitrary path with possibly numerous rotation points p.

Figure 12A:
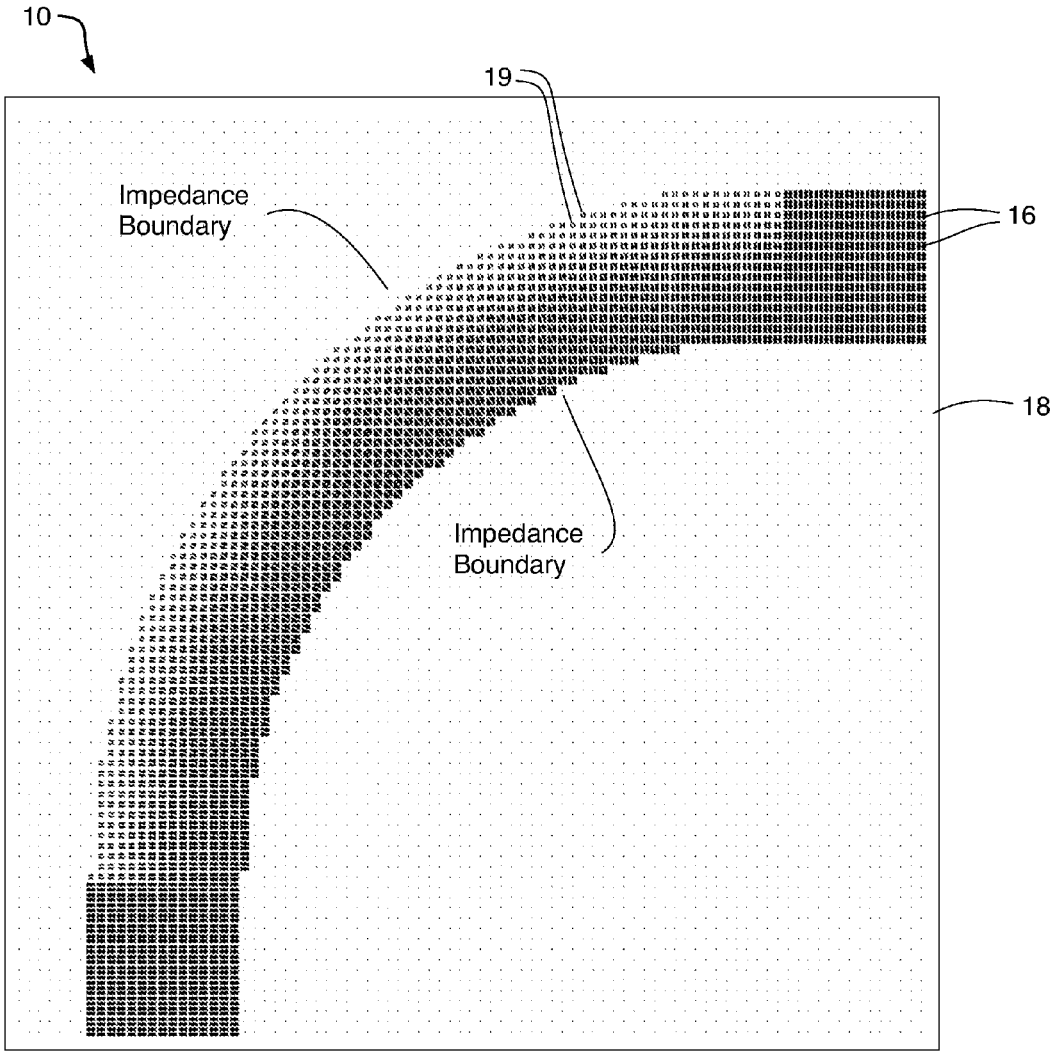
FIGS. 12*a* and 12*b* depict embodiments of an artificial impedance surface that can turn a wave front by ninety degrees with a constant radius in a phase-preserving fashion.
Figure 12B:
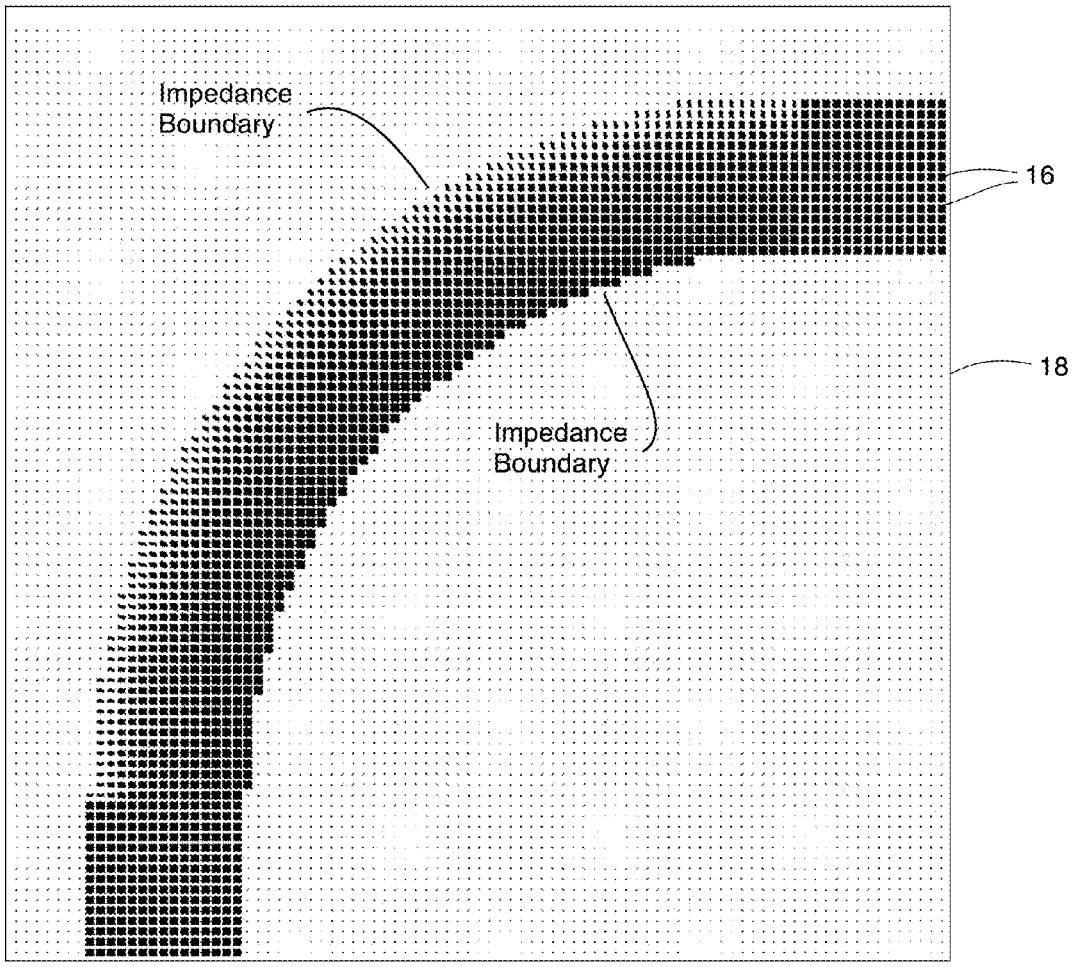

FIGS. 12*a* and 12*b* depict embodiments of an artificial impedance surface that turns a wave front by ninety degrees with a constant radius. In FIG. 12*a* the patches 16 are sliced (as shown in greater detail in FIG. 9*b*) with the angle of the slices forming gaps 19 rotating to follow a radius of the ninety degree turn. In FIG. 12*b* the individual patches 16 sometimes have a bar configuration (as shown in greater detail in FIG. 9*c*). Note that many of the bar shaped patches 16 in FIG. 12*b* have a direction of elongation which closely follow a radius of the ninety degree turn.

In FIGS. 12*a* and 12*b* the regions outboard and inboard the defined regions within which wavefront is rotating (outside the impedance boundaries), the dielectric surface 18 may have very small patches therein or be devoid of patches.

The preceding embodiments can be used together to go from point sources (formed by dipole antennas for example) to surface waves and vice versa and the surface waves can be made to follow some smooth, arbitrary path (for example, between point sources, as in the embodiments of FIGS. 8 and/or 8*a*), by connecting the embodiments of FIGS. 11*a* and/or 11*b* together (with differing radiuses as needed) to follow some desired path. The surface waves can also be made to avoid some shielded region (as in FIG. 10). And this can be done with a phase preserving fashion along the wavefront by following the teachings contained herein.

The embodiments of FIGS. 11*a* and 11*b* provide artificial impedance surface 10 for rotating a surface wave on the artificial surface 10 about a point "p" along a circumferential path "c" (see FIG. 11*a*) relative to point "p" in a phase preserving manner along the circumferential path "c".

The path "c" can have a varying radius, so that the path "c" need not follow the circumference of a circle. For example, a parabolic curve can be approximated at each point as a circumferential path of a certain radius. But as one moves along the parabola, the radius of the approximating circle changes. So by changing the radius R in Eqn. 5 as the path moves along the surface, nearly any arbitrary path can be synthesized by this approach.

Sometimes it can be advantageous to contain the surface wave within an impedance channel or strip, which will now be described.

Impedance Channels

Figure 13:
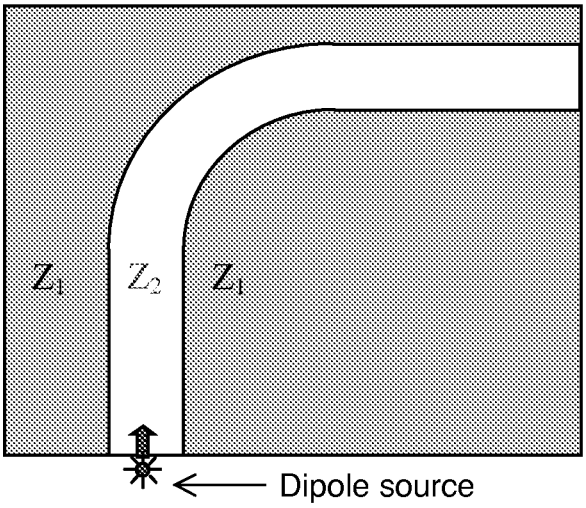
FIG. 13 depicts a curved impedance channel/surface waveguide.
Figure 16A:
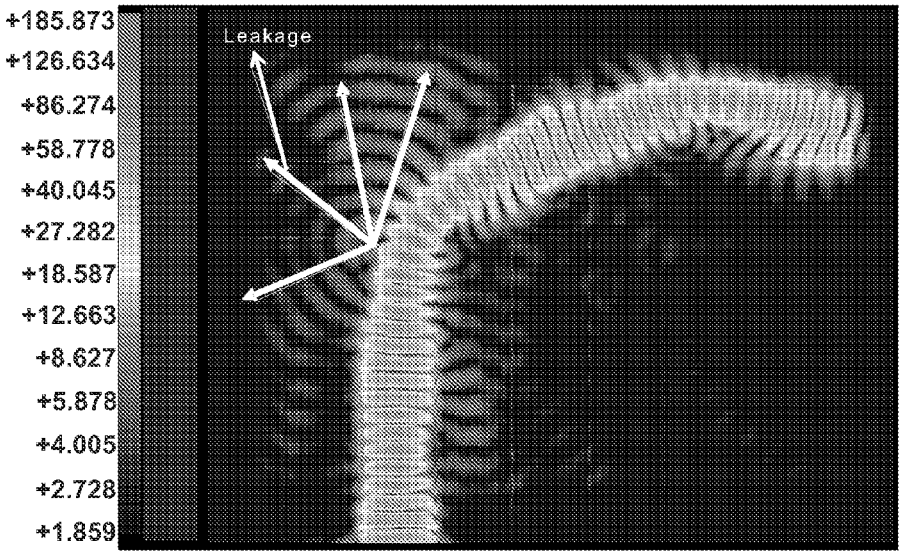
FIG. 16*a* depicts log 100 scale surface currents for an isotropic constant-impedance waveguide which shows noticeably more leakage than FIG. 16*b* which depicts log 100 scale surface currents for a graded tensor impedance waveguide.
Figure 16B:
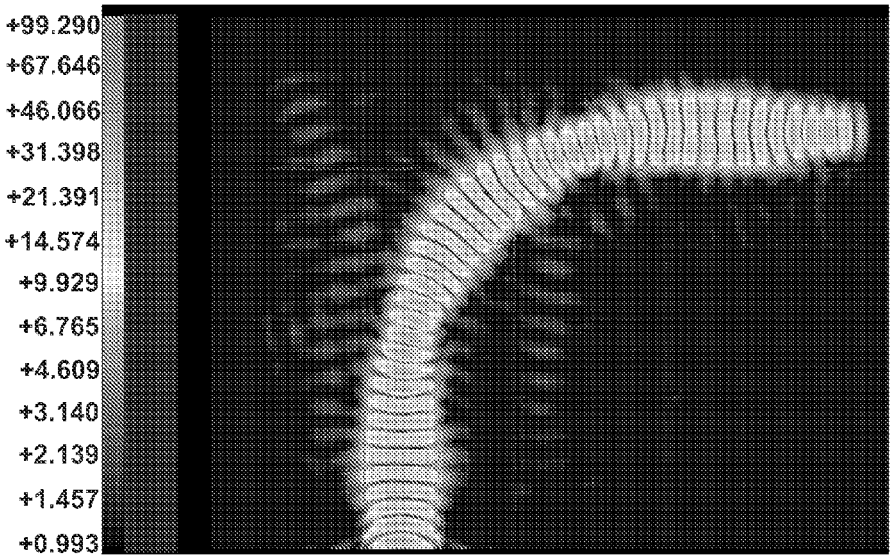

A high surface impedance strip can act as a two-dimensional waveguide. The surface wave remains bound and confined to the strip, and it propagates along its trace. This phenomenon, driven by two-dimensional total internal reflections, can be shown to also work for curved impedance strips such as the sharp bend shown in FIG. 13. In this design the surface impedance $Z_2$ within the channel is maintained constant as opposed to varied as described above with a surface impedance $Z_1$ outside the channel. A dipole source can supply a wavefront to the channel. But as the simulation in FIGS. 16*a* and 16*b* illustrate for the case of a TM wave, an isotropic constant-impedance curved channel waveguide does not preserve phase rather it triggers new modes, and it exhibits some energy leakage. These shortcomings can be eliminated by applying the concepts presented above, which are summarized again in FIG. 14. First, the impedance along the cross-section of the waveguide is graded such that the electrical path remains the same for all radii within the curved section of the waveguide. If $R_c$ is the radius at the center of the waveguide, then the effective impedance in the direction of propagation at other radii R is prescribed to be $Z_R = -I X_R$ (TM case), where $$X_R = \sqrt{\left(\frac{R_c}{R}\right)^2 (1 + X_c^2) - 1}\,.$$

This preserves the wavefront and eliminates the onset of additional modes ("zigzagging" of wave through waveguide). Second, we leverage the fact that an anisotropic impedance surface with a diagonalizable matrix tends to favor propagation along its shorter principal axis for TM waves (along longer axis for TE waves) as discussed above. So we define the impedance matrix to have its shorter axis of length $X_R$ pointing in the propagation direction along the curved waveguide, and we prescribe the perpendicular axis length to be a value greater than $X_R$.

Figure 15A:
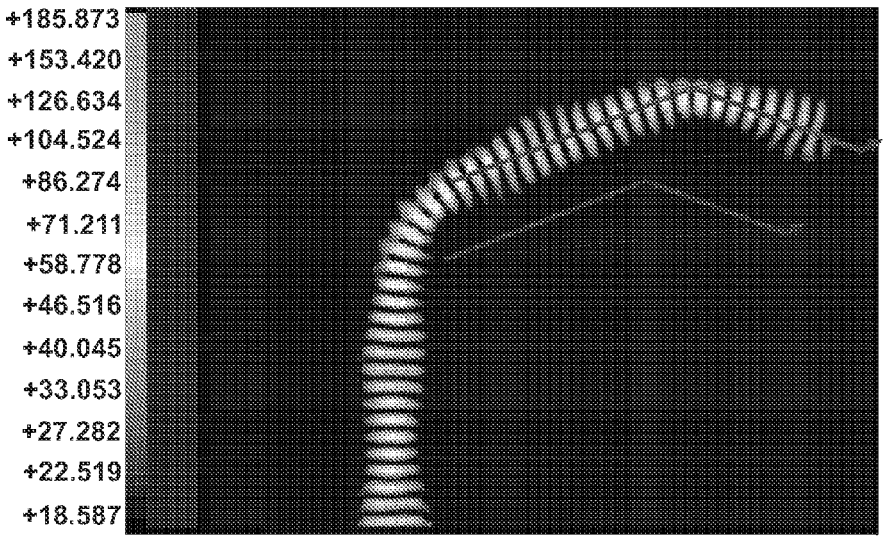
Figure 15B:
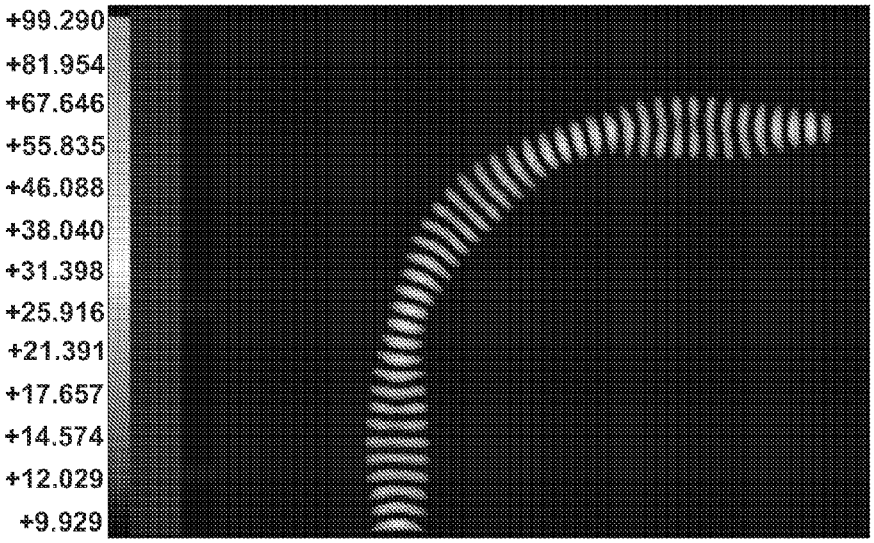
FIG. 15*b* depicts log 10 scale surface currents a graded tensor impedance waveguide with perfectly preserved phase.

We demonstrate the improved performance of the surface waveguide with FastScat (trademark of HRL Laboratories for computer code which calculates and models electromagnetic scattering) simulation results. FIGS. 15*a* and 15*b* show the surface currents normalized to a log scale spanning one order of magnitude. FIG. 15*a* shows how the scalar constant-impedance waveguide currents lose phase coherence after negotiating the bend, resulting in a "zigzagging" propagation pattern. In contrast, the currents for the graded tensor impedance waveguide smoothly negotiate the bend, perfectly preserving the phasefront as can be seen in FIG. 15*b*. FIGS. 16*a* and 16*b* show the same results on a log scale spanning two orders of magnitude to highlight lower level currents. FIG. 16*a* shows the constant-impedance waveguide with noticeably more leakage current from the curved section of the waveguide, especially at outer boundary where the bend begins. This is due to the fact that the wave is reaching the outer bend at some finite angle that is larger than the total internal reflection angle, and therefore, some of the energy is transmitted through the impedance interface. The graded tensor-impedance waveguide surface, on the other hand, helps steer the wave so that it hits the outer boundary at a more grazing angle, which results in less energy leakage, as shown in FIG. 16*b*.

This invention enables, for example, transmitting power over surfaces far more efficiently than is possible by uncontrolled surface propagation. By achieving surface waveguide-like propagation, power remains bound to the surface and localized to a narrow path. This provides more secure communication since waves remain attached to the surface, whereas antenna-based wireless communication may also broadcast sensitive information to the surroundings.

Alternatively, in point to point surface communication, the surface wave emanating from a point can be made to spread out over a large surface area and then converge back to the receiving end point, providing an extreme degree of robustness and survivability against significant damage to the wave transmitting surface using the embodiments of FIGS. 8 and 8*a*, for example.

In general, this surface wave propagation control technique disclosed herein can be used in air and ground vehicles, on satellites, in civil engineering type structures such as buildings and bridges, and on surfaces where features should be avoided to avoid creating interference and undesired scattering. The dielectric surface on which the array(s) of patches are disposed need not be planar but rather may follow a reasonable surface contour as needed or desired.

The surface wave propagation control techniques disclosed herein can have abrupt boundaries (in which case the arrays of electrically conductive patches or elements then define what might well be called waveguides). But these waveguides differ from conventional waveguides due to the desired impedance distribution caused by the varying of the shapes, sizes and/or orientations of the electrically conductive patches or elements between the impedance boundaries which define essentially "walls" of the waveguide. One the other hand, the surface wave propagation control techniques disclosed herein need not use "walls" or "waveguide" like structures with sharp impedance boundaries, rather these techniques can be used on open surfaces where the impedance distribution on the open surface simply follows the formulas presented above.

This concludes the description of the preferred embodiments of the present technology. The foregoing description of one or more embodiments of the technology has been presented for the purposes of illustration and description. It is not intended to be exhaustive or to limit the technology to the precise form disclosed. Many modifications and variations are possible in light of the above teaching. It is intended that the scope of the technology be limited not by this detailed description, but rather by the claims appended hereto.

What is claimed is:

1. A surface supporting transverse electric (TE) or transverse magnetic (TM) surface bound waves, said surface having one or more arrays of electrically conductive patches arranged thereon to urge said transverse electric or a transverse magnetic surface bound waves to follow an arbitrary path, having a smoothly changing radius of curvature, while maintaining a phase preserving wavefront along said arbitrary path, wherein the one or more arrays of electrically conductive patches gradually change size and/or shape and/or orientation within a defined region on said surface where the surface bound waves propagate, in use, along said arbitrary path.

2. A waveguide for rotating a propagating surface wave on a surface, the waveguide rotating the surface wave with respect to a point on or adjacent said surface and along a circumferential path on said surface defined relative to said point, wherein the surface has a two dimensional array of electrically conductive patches disposed thereon which, in use, rotates the propagating surface wave in a phase preserving manner along said circumferential path, said surface having a surface impedance defined by $$X_R = \sqrt{\left(\frac{R_C}{R}\right)(1 + X_C^2) - 1},$$

where $X_R$ is a principal axis impedance magnitude at a radius R relative to said point, expressed as a function of the impedance magnitude $X_c$ at a radius $R_c$, where $R_c$ corresponds to a radius of said circumferential path and the propagating surface wave is a TM wave.

3. A waveguide for rotating a propagating surface wave on a surface, the waveguide rotating the surface wave with respect to a point on or adjacent said surface and along a circumferential path on said surface defined relative to said point, wherein the surface has a two dimensional array of electrically conductive patches disposed thereon which, in use, rotates the propagating surface wave in a phase preserving manner along said circumferential path, said surface having a surface impedance defined by $$Y_R = \frac{1}{\sqrt{\left(\frac{R_c}{R}\right)^2\left(1 + \frac{1}{Y_c^2}\right) - 1}},$$

where $Y_R$ is a principal axis admittance magnitude at a radius R relative to said point, expressed as a function of the admittance magnitude $Y_c$ at a radius $R_c$, where $R_c$ corresponds to a radius of said circumferential path and the propagating surface wave is a TE wave.

4. A waveguide for rotating a propagating surface wave on a surface, the waveguide rotating the surface wave with respect to a point on or adjacent said surface and along a circumferential path on said surface defined relative to said point, wherein the surface has a two dimensional array of electrically conductive patches disposed thereon which, in use, rotates the propagating surface wave in a phase preserving manner along said circumferential path, wherein the array of electrically conductive patches gradually change size and/or shape and/or orientation within a defined region on said surface where the propagating surface wave propagates, in use, along said circumferential path.

5. The waveguide of claim 4 wherein at least one impedance boundary is defined at an edge of said defined region, the at least one impedance boundary being defined by a step change in the sizes of the electrically conductive patches within said defined region compared to the sizes of electrically conductive patches outside said defined region and immediately adjacent said at least one impedance boundary.

6. The waveguide of claim 5 wherein said step change at said at least one impedance boundary is equal to at least one order of magnitude.

7. The waveguide of claim 4 wherein at least one impedance boundary is defined at an edge of said defined region, the at least one impedance boundary being defined where an absence of electrically conductive patches outside of said defined region occur.

8. A surface supporting transverse electric (TE) or transverse magnetic (TM) surface bound waves, said surface having one or more arrays of electrically conductive patches arranged thereon to urge said transverse electric or a transverse magnetic surface bound waves to follow an arbitrary path, having a smoothly changing radius of curvature, while maintaining a phase preserving wavefront along said arbitrary path, wherein at least one of said arrays of electrically conductive patches has a surface impedance defined by $$Y_R = \frac{1}{\sqrt{\left(\frac{R_c}{R}\right)^2\left(1 + \frac{1}{Y_c^2}\right) - 1}},$$

where $Y_R$ is a principal axis admittance magnitude at a radius R relative to a point, expressed as a function of the admittance magnitude at a radius $R_c$, where $R_c$ corresponds to a radius of a circumferential path forming a portion of said arbitrary path.

9. A surface supporting transverse electric (TE) or transverse magnetic (TM) surface bound waves, said surface having one or more arrays of electrically conductive patches arranged thereon to urge said transverse electric or a transverse magnetic surface bound waves to follow an arbitrary path, having a smoothly changing radius of curvature, while maintaining a phase preserving wavefront along said arbitrary path, wherein at least one of said arrays of electrically conductive patches has a surface impedance defined by $$X_R = \sqrt{\left(\frac{R_c}{R}\right)^2 (1 + X_c^2) - 1},$$

where $X_R$ is a principal axis impedance magnitude at a radius R relative to a point, expressed as a function of the impedance magnitude at a radius $R_c$, where $R_c$ corresponds to a radius of a circumferential path forming a portion of said arbitrary path.

* * * * *